US012781723B2

(12) United States Patent
Huang et al.

(10) Patent No.: US 12,781,723 B2
(45) Date of Patent: Nov. 3, 2026

(54) COMPRESSOR AND REFRIGERATION DEVICE

(71) Applicant: ANHUI MEIZHI COMPRESSOR CO., LTD., Hefei (CN)

(72) Inventors: Gang Huang, Hefei (CN); Yangyang Zhang, Hefei (CN); Kun Wang, Hefei (CN); Zihan Yan, Hefei (CN); Tao Ma, Hefei (CN)

(73) Assignee: ANHUI MEIZHI COMPRESSOR CO., LTD., Hefei (CN)

( * ) Notice: Subject to any disclaimer, the term of this patent is extended or adjusted under 35 U.S.C. 154(b) by 0 days.

(21) Appl. No.: 18/806,204

(22) Filed: Aug. 15, 2024

(65) Prior Publication Data

US 2024/0426285 A1 Dec. 26, 2024

Related U.S. Application Data

(63) Continuation of application No. PCT/CN2022/095996, filed on May 30, 2022.

(30) Foreign Application Priority Data

Feb. 18, 2022 (CN) ..... 202210155326.6

(51) Int. Cl.
*F04B 19/22* (2006.01)
*F25B 5/02* (2006.01)
*F25B 31/02* (2006.01)

(52) U.S. Cl.
CPC ..... *F04B 19/22* (2013.01); *F25B 5/02* (2013.01); *F25B 31/02* (2013.01); *F25B 31/023* (2013.01)

(58) Field of Classification Search
CPC ..... F25B 5/02; F25B 31/02; F25B 31/023; F04B 19/22

(Continued)

(56) References Cited

U.S. PATENT DOCUMENTS 793,864 A 7/1905 Voorhees
2,123,497 A * 7/1938 Leslie ..... F25B 31/00 62/200

(Continued)

FOREIGN PATENT DOCUMENTS

CN 101321996 A 12/2008
CN 103615377 A 3/2014

(Continued)

OTHER PUBLICATIONS

Extended European search report dated Dec. 17, 2024 received in European Patent Application No. 22926641.6.

(Continued)

*Primary Examiner* — Christopher S Bobish
(74) *Attorney, Agent, or Firm* — Anova Law Group, PLLC

(57) ABSTRACT

A compressor and a refrigeration device are provided. The compressor includes a cylinder body and a piston assembly. The cylinder body has a first air suction hole at a cylinder cover of the cylinder body. The piston has a top dead center located close to the cylinder cover of the cylinder body and a bottom dead center located away from the cylinder cover of the cylinder body in a movement stroke. A distance between the top dead center and the bottom dead center is S. The cylinder body or the piston has a second air suction hole. The second air suction hole is configured to connect to the operating cavity when the piston moves to a predetermined position. The distance between the piston at the predetermined position and the top dead center is L1, where L1>0.5 S.

10 Claims, 2 Drawing Sheets

(58) Field of Classification Search
USPC ..... 417/493
See application file for complete search history.

(56) References Cited

U.S. PATENT DOCUMENTS

| | | | | | |
|---|---|---|---|---|---|
| 2,334,939 | A * | 11/1943 | Larson | F04B 49/24 | 417/440 |
| 3,759,057 | A * | 9/1973 | English | F04B 49/16 | 62/196.3 |
| RE34,252 | E * | 5/1993 | Pien | F02M 43/02 | 123/304 |
| 6,318,977 | B1 * | 11/2001 | Kopko | F04B 39/0016 | 417/493 |
| 9,399,988 | B2 * | 7/2016 | Brooke | F04B 39/123 | |
| 2008/0190125 | A1 * | 8/2008 | Yoshioka | F25B 5/02 | 62/503 |
| 2013/0199223 | A1 * | 8/2013 | Brooke | F04B 39/122 | 62/126 |
| 2018/0252193 | A1 * | 9/2018 | Fairbairn | F02M 55/025 | |
| 2018/0258922 | A1 * | 9/2018 | Ascani | F25B 31/023 | |

FOREIGN PATENT DOCUMENTS

| | | | |
|---|---|---|---|
| CN | 105004100 | A | 10/2015 |
| CN | 106091455 | A | 11/2016 |
| CN | 107407265 | A | 11/2017 |
| CN | 109974345 | A | 7/2019 |
| CN | 216812092 | U | 6/2022 |
| CN | 116163918 | A | 5/2023 |
| CN | 116163922 | A | 5/2023 |
| CN | 116163923 | A | 5/2023 |
| CN | 116163925 | A | 5/2023 |
| CN | 116163926 | A | 5/2023 |
| CN | 116378932 | A | 7/2023 |
| GB | 190504448 | A | 8/1905 |
| JP | S5751979 | A | 3/1982 |
| JP | H04255581 | A | 9/1992 |
| JP | 2017538070 | A | 12/2017 |

OTHER PUBLICATIONS

International Search Report and Written Opinion dated May 30, 2022 issued in PCT/CN2022/095996.
First office Action dated Mar. 28, 2025 received in Chinese Patent Application No. 202210155326.6.
Second Office Action dated Aug. 4, 2025 received in Chinese Patent Application No. 202210155326.6.
Lambers, K et al., "Port Optimization of a Voorhees Modified CO2 Compressor Using Indicator Diagram Analysis", International Compressor Engineering Conference at Purdue, 2006, pp. 1-9.
Office Action dated Jun. 27, 2025 received in Japanese Patent Application No. 2024-554529.
Office Action dated Oct. 1, 2025 received in European Patent Application No. 22926641.6.
Office Action dated Nov. 25, 2025 received in Chinese Patent Application No. 202210155326.6.
Office Action dated Nov. 18, 2025 received in Korean Patent Application No. 10-2024-7025046.
Office Action dated Dec. 9, 2025 received in Japanese Patent Application No. 2024-544529.
Chinese Rejection Decision dated Jan. 30, 2026 received in Chinese Application No. 202210155326.6.
Japanese Decision to Grant a Patent dated Apr. 14, 2026 received in Japanese Patent Application No. 2024-544529.

* cited by examiner

COMPRESSOR AND REFRIGERATION DEVICE

CROSS-REFERENCE TO RELATED APPLICATIONS

This application is a continuation application of International Application No. PCT/CN2022/095996 filed on May 30, 2022, which claims priority to Chinese Patent Application No. 202210155326.6, filed on Feb. 18, 2022, the entire contents of each of which are incorporated herein by reference for all purposes. No new matter has been introduced.

FIELD

The present disclosure relates to the field of compressor technologies, and more particularly, to a compressor and a refrigeration device.

BACKGROUND

A compressor is a core component of a refrigeration system and a major energy-consuming component, and the requirement of refrigeration performance and energy-efficiency level for the compressor is relatively high. Household refrigerators generally have a freezer compartment and a refrigerator compartment. In the process of cooling down the freezer compartment and the refrigerator compartment, refrigerant evaporation temperatures of the freezer compartment and the refrigerator compartment are different, and refrigerant pressures of the freezer compartment and the refrigerator compartment are also different.

An existing compressor is connected in series to the freezer compartment and the refrigerator compartment through an air suction tube line to realize refrigeration functions of the freezer compartment and the refrigerator compartment, resulting in a low coefficient of performance (COP) of the refrigerator. In order to improve the COP, a new single-cylinder double independent air suction pump structure, different from a traditional single air suction and single exhaust compression pumping mechanism, has an ability to significantly improve an overall performance of a reciprocating compressor. When the compressor is in operation, in order to improve a refrigeration capacity and energy-efficiency COP of the compressor, a second air suction hole is added. However, during an operating process of a cylinder of the compressor, refrigerant needs of the freezer compartment and the refrigerator compartment are different due to their different refrigeration needs.

SUMMARY

A main objective of the present disclosure is to at least provide a compressor and a refrigeration device, aiming at providing a compressor capable of realizing double air suction and rationally distributing a main air suction quantity and a make-up quantity.

To achieve the above objectives, the present disclosure provides a compressor. The compressor includes: a cylinder body having a first air suction hole formed at a cylinder cover of the cylinder body, the first air suction hole being configured to be connect to a first refrigeration flow path; and a piston assembly including a piston movably disposed in the cylinder body, an operating cavity being formed between the piston and a bottom of the cylinder body, the piston having a top dead center at the cylinder cover of the cylinder body and a bottom dead center away from the cylinder cover of the cylinder body in a movement stroke, and a distance between the top dead center and the bottom dead center being S. The cylinder body or the piston has a second air suction hole configured to connect to a second refrigeration flow path, the second air suction hole being configured to connect to the operating cavity when the piston moves to a predetermined position. A distance between the piston at the predetermined position and the top dead center is L1, where $L1>0.5$ S.

In an embodiment, a second air suction hole penetrates a sidewall of the cylinder body. A distance between the second air suction hole and the top dead center is L2, where $L2>0.5$ S.

In an embodiment, a sidewall of the piston covers and seals the second air suction hole when the piston is located at the top dead center.

In an embodiment, the second air suction hole is a circular hole.

In an embodiment, a diameter of the second air suction hole is D1, where $D1\leq 6$ mm.

In an embodiment, the compressor further includes: a first air suction tube, the first refrigeration flow path being in communication with the first air suction hole through the first air suction tube; and a second air suction tube, the second refrigeration flow path being in communication with the second air suction hole through the second air suction tube.

In an embodiment, an inner diameter of the second air suction tube is d1, and an outer diameter of the second air suction tube is d2, where $0.3\text{ mm}\leq d1\leq 6$ mm, and $0.4\text{ mm}\leq d2\leq 12.5$ mm.

The present disclosure further provides a refrigeration device. The refrigeration device includes the compressor described above, and the compressor includes a cylinder body having a first air suction hole formed at a cylinder cover of the cylinder body, the first air suction hole being configured to connect to a first refrigeration flow path; and a piston assembly including a piston movably disposed in the cylinder body, an operating cavity being formed between the piston and a bottom of the cylinder body, the piston having a top dead center at the cylinder cover of the cylinder body and a bottom dead center away from the cylinder cover of the cylinder body in a movement stroke, and a distance between the top dead center and the bottom dead center being S. The cylinder body or the piston has a second air suction hole configured to connect to a second refrigeration flow path, the second air suction hole being configured to connect to the operating cavity when the piston moves to a predetermined position. A distance between the piston at the predetermined position and the top dead center is L1, where $L1>0.5$ S.

In an embodiment, the refrigeration device is a refrigerator.

In an embodiment, an intake pressure of the first air suction hole is P1, and an intake pressure of the second air suction hole is P2, where $1<P2/P1\leq 6$.

In a technical solution provided by the present disclosure, the compressor includes the cylinder body and the piston assembly. The cylinder body has the first air suction hole formed at the cylinder cover of the cylinder body, and the first air suction hole is configured to connect to a first refrigeration flow path. The piston assembly includes the piston movably disposed in the cylinder body. The operating cavity is formed between the piston and the bottom of the cylinder body. The piston has the top dead center at the cylinder cover of the cylinder body and the bottom dead center away from the cylinder cover of the cylinder body in the movement stroke, and the distance between the top dead center and the bottom dead center is S. The cylinder body or the piston has the second air suction hole configured to connect to the second refrigeration flow path. The second air suction hole is configured to connect to the operating cavity when the piston moves to the predetermined position. A distance between the piston at the predetermined position and the top dead center is L1, where L1>0.5 S. The first refrigeration flow path corresponds to a freezer compartment of the refrigerator. Since a refrigeration capacity required by the freezer compartment is large, a required refrigerant quantity is large, and a refrigerant pressure consumed by the refrigerator freezer compartment is also large during an operating process. The second refrigeration flow path corresponds to a refrigerator compartment of the refrigerator. Since a refrigeration capacity required by the refrigerator compartment is small, a refrigerant pressure consumed by the refrigerator compartment is also small. In this way, a pressure flowing back into the first air suction hole is far less than a pressure of the second air suction hole, but the refrigerant quantity in the first refrigeration flow path is relatively large. Therefore, when the compressor is in operation, the piston first opens the first air suction hole in a first major part stroke of an air suction to perform a main air suction, and a relatively large refrigerant quantity on the refrigeration flow path corresponding to the freezer compression can be sucked. In a latter minor part stroke of the air suction, the second air suction hole is in communication with the operating cavity, and the first air suction hole is closed. The second air suction hole starts to supplement high-pressure refrigerant airflow, and continues to supplement airflow during a first minor part stroke of a compression stage. Finally, during a latter major part stroke of the compression stage, the second air suction hole is closed, and the piston compresses a refrigerant in the operating cavity. Therefore, not only the refrigeration capacity and COP of the compressor are effectively improved, but also refrigerant airflow with different pressures on the two refrigeration flow paths can be reasonably distributed and returned to the compressor, which provides a compressor capable of realizing double air suction and reasonably distributing main air suction quantity and a make-up quantity.

BRIEF DESCRIPTION OF THE DRAWINGS

Description of the Drawings

In order to clearly explain technical solutions in the embodiments of the present disclosure or in the related art, drawings used in the description of the embodiments or the related art are briefly described below. Obviously, the drawings as described below are merely some embodiments of the present disclosure. Based on structures illustrated in these drawings, other drawings can be obtained by those skilled in the art without creative effort.

Figure 1:
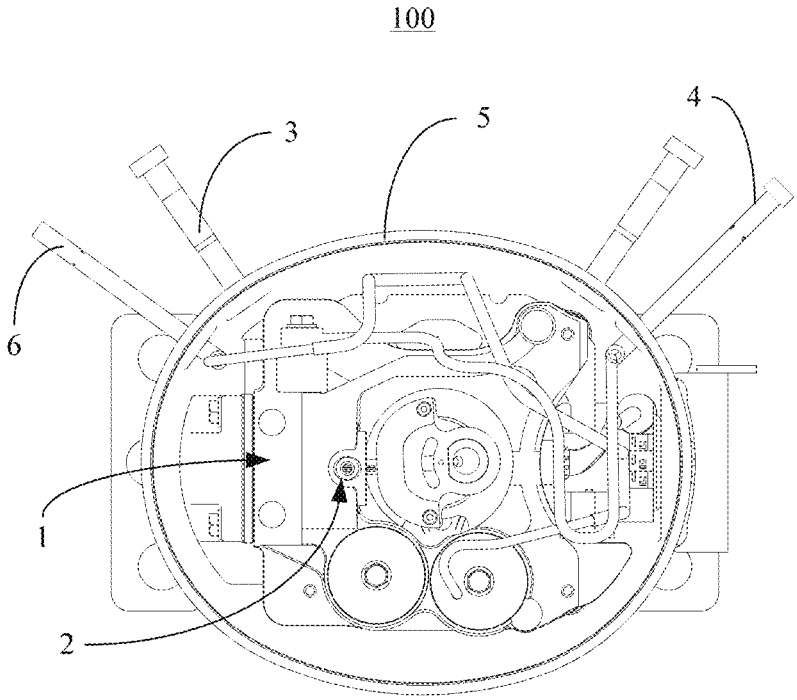

FIG. 1 is a schematic view showing an internal structure of a compressor according to an embodiment of the present disclosure.

Figure 2:
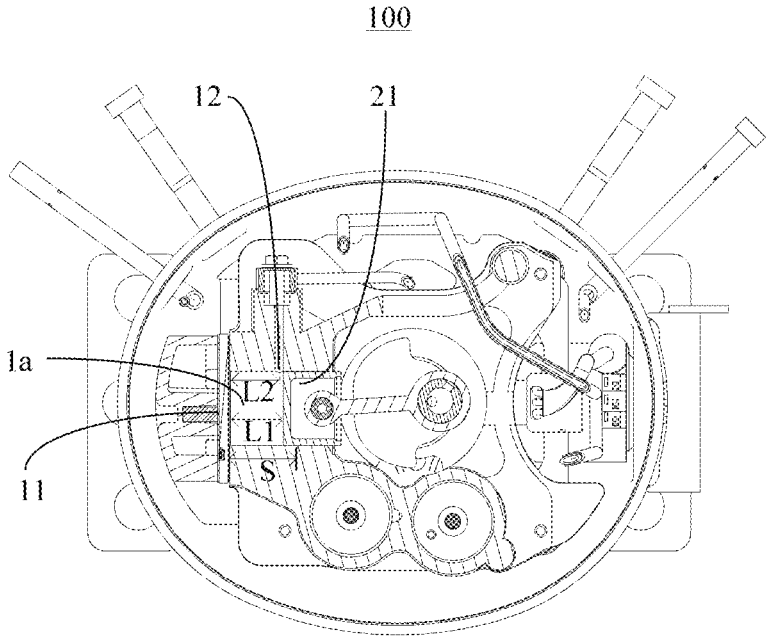

FIG. 2 is a schematic sectional view of a compressor according to an embodiment of the present disclosure.

Figure 3:
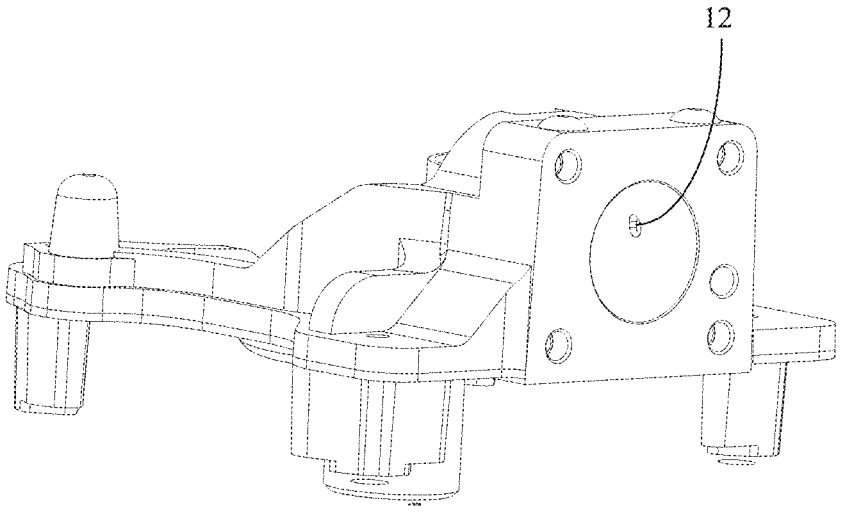

FIG. 3 is a schematic perspective view of the compressor in FIG. 1.

DESCRIPTION OF REFERENCE NUMERALS OF ACCOMPANYING DRAWINGS

| Reference numerals | Name | Reference numerals | Name |
|---|---|---|---|
| 100 | compressor | 21 | piston |
| 1 | cylinder body | 3 | first air suction tube |
| 1a | operating cavity | 4 | second air suction tube |
| 11 | first air suction hole | 5 | housing |
| 12 | second air suction hole | 6 | exhaust outer tube |
| 2 | piston assembly | | |

The implementation of the objectives, functional features and advantages of the present disclosure will be further described in conjunction with embodiments and with reference to the accompanying drawings.

DETAILED DESCRIPTION OF EMBODIMENTS

Technical solutions according to embodiments of the present disclosure will be described below in combination with accompanying drawings of the embodiments of the present disclosure. Obviously, the embodiments described below are only a part of the embodiments of the present disclosure, rather than all of the embodiments. On a basis of the embodiments in the present disclosure, all other embodiments obtained by a person skilled in the art without creative labor shall fall within the protection scope of the present disclosure.

It should be noted that if there is a directional indication (such as up, down, left, right, front, rear, etc.) involved in the embodiment of the present disclosure, the directional indication is only used to explain the relative position relationship, motion situation, etc. between the components in a certain specific posture (as shown in the accompanying drawings), and if the specific posture changes, the directional indication changes accordingly.

In addition, if there are descriptions involving "first", "second", and the like in the embodiments of the present disclosure, the descriptions of "first" and "second" are only used for descriptive purposes, and cannot be understood as indicating or implying relative importance or implicitly indicating the number of the indicated technical features. Therefore, the features associated with "first" and "second" may explicitly or implicitly include at least one of the features. In addition, the meaning of "and/or" appearing in the whole text includes three parallel solutions, taking "A and/or B" as an example, including solution A, or solution B, or solution A and B simultaneously satisfied. In addition, technical solutions of various embodiments may be combined with each other, but they must be based on what can be achieved by a person skilled in the art. When the combination of technical solutions is contradictory or cannot be achieved, it shall be deemed that such combination of technical solutions does not exist, and is not within the scope of protection claimed in the present disclosure.

As a core component of a refrigeration system and a major energy-consuming component, a compressor puts forward higher requirements for refrigeration performance and energy-efficiency level. Household refrigerators generally have a freezer compartment and a refrigerator compartment. In the process of cooling down the freezer compartment and the refrigerator compartment, their refrigerant evaporation temperatures are different, and their refrigerant pressures are also different. An existing compressor is connected in series to the freezer compartment and the refrigerator compartment through an air suction tube line to realize refrigeration functions of the freezer compartment and the refrigerator compartment, resulting in a low coefficient of performance (COP) of the refrigerator. In order to achieve a better COP, a new single-cylinder double independent air suction pump structure, different from a traditional single air suction and single exhaust compression pumping mechanism, has an ability to significantly improve an overall performance of a reciprocating compressor. When the compressor is in operation, in order to improve a refrigeration capacity and energy-efficiency COP of the compressor, a second air suction hole is added. However, during an operating process of a cylinder of the compressor, refrigerant needs of the freezer compartment and the refrigerator compartment are different due to their different refrigeration needs.

To solve the above problems, the present disclosure provides a compressor 100, and FIG. 1 to FIG. 3 are specific embodiments of the compressor 100 provided in the present disclosure.

Taking a refrigeration system in which the compressor 100 is used for the refrigerator as an example, in a refrigeration process of the refrigerator, high-temperature and high-pressure refrigerant airflow is transmitted from the compressor to corresponding evaporators of the freezer compartment and the refrigerator compartment for evaporation and heat absorption, to realize the refrigeration of the freezer compartment and the refrigerator compartment. However, temperatures set by the freezer compartment and the refrigerator compartment are not consistent, and evaporation temperatures of the two are different. Temperatures and pressures of the refrigerant after heat exchange in the freezer compartment and the refrigerator compartment are different, and in the related art, the compressor realizes a refrigeration function of freezing and refrigerating through a flow path. Therefore, no matter whether the freezer compartment or the refrigerator compartment needs refrigeration, a whole heat exchange system needs to participate in the operation, allowing energy consumption to be large and COP to be relatively low.

Referring to FIG. 1 to FIG. 3, the compressor 100 includes a cylinder body 1 and a piston assembly 2. The cylinder body 1 has a first air suction hole 11 at a cylinder cover of the cylinder body 1, and the first air suction hole 11 is configured to configured to connect to a first refrigeration flow path. The piston assembly 2 includes a piston 21 movably disposed in the cylinder body 1. An operating cavity 1*a* is formed between the piston 21 and a bottom of the cylinder body 1. The piston 21 has a top dead center at the cylinder cover of the cylinder body 1 and a bottom dead center away from the cylinder cover of the cylinder body 1 in a movement stroke. A distance between the top dead center and the bottom dead center is S. The cylinder body 1 or the piston 21 has a second air suction hole 12 configured to connect to a second refrigeration flow path. The second air suction hole 12 is configured to connect to the operating cavity 1*a* when the piston 21 moves to a predetermined position. A distance between the piston 21 at the predetermined position and the top dead center is L1, where L1>0.5 S.

In a technical solution provided by the present disclosure, the compressor 100 includes the cylinder body 1 and the piston assembly 2. The cylinder body 1 has the first air suction hole 11 configured to connect to the first refrigeration flow path. The piston assembly 2 includes a piston 21 movably disposed in the cylinder body 1. The piston 21 has the top dead center at the cylinder cover of the cylinder body 1 and a bottom dead center away from the cylinder cover of the cylinder body 1 in the movement stroke, and the distance between the top dead center and the bottom dead center is S. The cylinder body 1 or the piston 21 has the second air suction hole 12 configured to connect to a second refrigeration flow path. The second air suction hole 12 is configured to connect to the operating cavity 1*a* when the piston 21 moves to a predetermined position. A distance between the piston 21 at the predetermined position and the top dead center is L1, where L1>0.5 S. The first refrigeration flow path corresponds to the freezer compartment of the refrigerator. Since a refrigeration capacity required by the freezer compartment is large, a refrigerant quantity required is large, and a refrigerant pressure consumed by the refrigerator freezer compartment is also large in an operating process. The second refrigeration flow path corresponds to a refrigerator compartment of the refrigerator. Since a refrigeration capacity required by the refrigerator compartment is small, a refrigerant pressure consumed by the refrigerator compartment is also small. In this way, a pressure flowing back into the first air suction hole 11 is far less than a pressure of the second air suction hole 12, but the refrigerant quantity in the first refrigeration flow path is relatively large. Therefore, when the compressor 100 is in operation, the piston 21 mainly opens the first air suction hole 11 to perform a main air suction in a first major part stroke of an air suction, and a relatively large refrigerant quantity on the refrigeration flow path corresponding to the freezer compression can be sucked. In a latter minor part stroke of the air suction, the second air suction hole 12 is in communication with the operating cavity 1*a*, and the first air suction hole 11 is closed. The second air suction hole 12 starts to supplement high-pressure refrigerant airflow, and continues to supplement airflow during a first minor part stroke of a compression stage. Finally, during a latter major part stroke of the compression stage, the second air suction hole 12 is closed, and the piston 21 compresses a refrigerant in the operating cavity 1*a*. Therefore, not only the refrigeration capacity and COP of the compressor 100 are effectively improved, but also refrigerant airflow with different pressures on the two refrigeration flow paths can be reasonably distributed and returned to the compressor 100, which provides a compressor 100 capable of realizing double air suction and reasonably distributing main air suction quantity and a make-up quantity.

It should be noted that, referring to FIG. 2, the distance between the piston 21 and the top dead center is L1, that is, a distance between an end surface of the piston 21 close to a bottom wall of the cylinder body 1 and the bottom wall of the cylinder body 1 is L1. The distance between the top dead center and the bottom dead center is S. That is, when an end surface of the piston 21, which is located close to an end of the bottom wall of the cylinder body 1, is moved to a closest distance close to the bottom wall of the cylinder body 1, the top dead center refers to a position where the piston 21 is located close to the end of the bottom wall of the cylinder body 1. When an end surface of the piston 21, which is located close to an end of the bottom wall of the cylinder body 1, moves to a farthest distance away from the bottom wall of the cylinder body 1, the bottom dead center refers to a position where the piston 21 is located close to the end of the bottom wall of the cylinder body 1. That is, the distance S is a distance between two limit states of the end surface of the piston 21 located close to the end of the bottom wall of the cylinder body 1

It can be understood that the second air suction hole 12 may be formed at the bottom wall of the cylinder body 1 and be opened and closed by a valve. When the piston 21 moves to the predetermined position, i.e., when a distance from the top dead center is greater than 0.5S, the valve is opened. The second air suction hole 12 is opened to supply air to the operating cavity 1*a*, and the first air suction hole 11 is closed at the same time. In other embodiments of the present disclosure, the second air suction hole 12 may further be formed at the piston 21, and the valve controls the second air suction hole 12 on the piston 21 to be opened and closed. Alternatively, the second air suction hole 12 is formed at a sidewall of the piston 21, and a groove corresponding to the second air suction hole 12 is formed at a sidewall of the cylinder body 1. The second air suction hole 12 corresponds to the groove when the piston 21 moves to the predetermined position by setting a position of the groove, allowing the second air suction hole 12 to be in communication with the operating cavity 1*a* through the groove to supply air. All of the above forms enable the piston 21 to open the second air suction hole 12 in a second half stroke of the air suction and a first half stroke of the compression. Therefore, an opening duration of the first air suction hole 11 is longer, that is, an air suction duration is longer. An air suction quantity of the first air suction hole 11 is larger, while an opening duration of the second air suction hole 12 is shorter, and an air supply duration is shorter. An air supply quantity corresponding to the second air suction hole 12 is reasonably small, allowing refrigerant quantity on the two refrigeration flow paths to be reasonably distributed.

In an exemplary embodiment of the present disclosure, the second air suction hole 12 penetrates the sidewall of the cylinder body 1. A distance between the second air suction hole 12 and the top dead center is L2, where L2>0.5 S. Since the first air suction hole 11 is provided with a control valve group configured to realize the opening and closing of the first air suction hole 11. The opening and closing states of the first air suction hole 11 and the second air suction hole 12 during the movement of the piston 21 are as follows.

Air suction strokes of the cylinder are as follows.

First stroke: the piston 21 moves to the bottom dead center from the top dead center, and the distance from the piston 21 to the top dead center is smaller than 0.5S. In the first stroke, the control valve group is opened, allowing the first air suction hole 11 to be conducted and the second air suction hole 12 to be blocked by the piston 21. In this case, the operating cavity 1*a* of the cylinder body 1 only performs air suction through the first air suction hole 11. In this case, a total refrigerant quantity in the operating cavity 1*a* comes from the first air suction hole 11, i.e., a refrigerant of the first refrigeration flow path. It can be understood that, when the piston 21 moves towards the bottom dead center, a compression space of the operating cavity 1*a* of the cylinder body 1 increases, and the cylinder body 1 is in a negative pressure state, which facilitates external airflow to enter the operating cavity 1*a* of the cylinder body 1 from the first air suction hole 11. Since a pressure of the airflow passing through the first air suction hole 11 is smaller than a pressure of the airflow passing through the second air suction hole 12, in this movement stroke, the second air suction hole 12 is blocked by the piston 21, to prevent the airflow of the second air suction hole 12 from blocking the airflow of the first air suction hole 11 from entering the operating cavity 1*a* of the cylinder body 1.

Second stroke: the piston 21 moves from a first dead center to a second dead center, and a distance from the first dead center is greater than 0.5S. In the second stroke, the piston 21 does not block the second air suction hole 12, allowing the second air suction hole 12 to be in communication with the operating cavity 1*a* of the cylinder body 1. In this case, the control valve group is switched between an open state and a closed state based on actual requirements. When the control valve group is in the open state, the first air suction hole 11 and the second air suction hole 12 simultaneously input airflow to the operating cavity 1*a* of the cylinder body 1. In the first stroke, a certain quantity of airflow is sucked into a space of the operating cavity 1*a* of the cylinder body 1 through the first air suction hole 11, allowing a certain airflow pressure to be maintained in the compression space. Therefore, when the airflow is input to the operating cavity 1*a* of the cylinder body 1 through the second air suction hole 12, the airflow of the first air suction hole 11 is less affected. Moreover, since the distance from the second air suction hole 12 to the first dead center is greater than 0.5S, i.e., the distance from the second air suction hole 12 to the first air suction hole 11 is greater than 0.5S, a proper buffer distance exists between the second air suction hole 12 and the first air suction hole 11, allowing an obstruction effect of the airflow of the second air suction hole 12 on the airflow of the first air suction hole 11 to be reduced and a compression energy efficiency to be improved. The second air suction hole 12 supplies airflow to the operating cavity 1*a* of the cylinder body 1 when the control valve group is in the closed state. In this case, a refrigerant supplied to the operating cavity 1*a* comes from the second air suction hole 12, that is, a refrigerant of the second refrigeration flow path flows back into the operating cavity 1*a* of the cylinder body 1. It can be understood that the closer the second air suction hole 12 is to a midpoint between the first dead center and the second dead center, the earlier the opening duration of the second air suction hole 12 is and the later the closing duration of the second air suction hole 12 is. The longer the duration of the high-pressure refrigerant provided by the second refrigeration flow path is, the larger the air supply quantity is. The closer the second air suction hole 12 is to the second dead center, the later the opening duration of the second air suction hole 12 is and the earlier the closing duration of the second air suction hole 12 is. The shorter the duration of the high-pressure refrigerant provided by the second refrigeration flow path is, the shorter the air supply duration is and thus the less the air supply quantity is. In reality, the position of the second air suction hole 12 may be provided based on demands of the air supply quantity.

Compression strokes of the cylinder are as follows.

Third stroke: the piston 21 moves from the bottom dead center to a direction close to the top dead center, and the distance from the bottom dead center to the top dead center is greater than 0.5S. In the third stroke, the control valve group is closed, and the piston 21 moves rapidly towards the top dead center. In this case, the second air suction hole 12 still inputs airflow to the operating cavity 1*a* of the cylinder body 1. In this case, the refrigerant supplied to the operating cavity 1*a* comes from the second air suction hole 12. Therefore, when the airflow in the operating cavity 1*a* of the cylinder body 1 is compressed in the third stroke, airflow input into the operating cavity 1*a* of the cylinder body 1 through the second air suction hole 12 is not excessively hindered, allowing the cylinder body 1 to still suck airflow in the compression stroke. Moreover, since airflow from the first air suction hole 11 and the second air suction hole 12 are mixed in the operating cavity 1*a* of the cylinder body 1, an airflow pressure in the operating cavity 1*a* of the cylinder body 1 is lower than an airflow pressure passing through the second air suction hole 12.

Fourth stroke: the piston 21 moves from the bottom dead center to the direction close to the top dead center, and the distance from the piston 21 to the top dead center is smaller than 0.5S. In the fourth stroke, the control valve group is still closed and the piston 21 blocks the second air suction hole 12. During this process, the piston 21 compresses the airflow in the operating cavity 1*a* of the cylinder body 1 into a high-pressure airflow. When the piston 21 moves to the bottom dead center, the air pressure in the operating cavity 1*a* of the cylinder body 1 is compressed to a certain level. In this case, the control valve group of a output tube configured to connect to the operating cavity 1*a* of the cylinder body 1 is switched from a closed state to an open state to output compressed high-pressure airflow.

In the technical solution of this embodiment, the second air suction hole 12 is disposed close to the bottom dead center. In this way, the compressor 100 does not need to specially provide the control valve group to control the opening and closing of the second air suction hole 12. However, an automatic opening and closing of the second air suction hole 12 can be realized in the movement stroke of the piston 21. This structure design is ingenious, and cost is also saved. Furthermore, by providing the distance between the second air suction hole 12 and the top dead center and the distance between the second air suction hole 12 and the bottom dead center, an air intake quantity of the second air suction hole 12 can be controlled. That is, due to the position of the second air suction hole 12, the piston 21 can adjust the opening and closing duration of the second air suction hole 12 when reciprocating. Therefore, a flow ratio between the first air suction hole 11 and the second air suction hole 12 can be adjusted.

It should be noted that operating circuits of the compressor 100 corresponding to the two refrigeration flow paths are as follows.

A flow path of airflow in a first air suction channel is that: a first external air suction tube→the first air suction hole 11→the operating cavity 1*a* of the cylinder body 1.

A flow path of airflow in a second air suction channel is that: a second external air suction tube→the second air suction hole 12→the operating cavity 1*a* of the cylinder body 1.

The compressor 100 further includes an inner exhaust tube configured to connect to the operating cavity 1*a* of the cylinder body 1, and the inner exhaust tube is configured to connect to an exhaust outer tube 6 to exhaust the compressed high-pressure airflow in the operating cavity 1*a* of the cylinder body 1 from the inner exhaust tube to the exhaust outer tube 6.

It should be noted that the distance between the second air suction hole 12 and the top dead center is L2, that is, the distance between a center line of the second air suction hole 12 and the top dead center is L2.

Further, in order to utilize the piston 21 to fully function as a valve opening and closing function, the piston 21 can enable the second air suction hole 12 to be in the closed state in the first stroke and the fourth stroke during the air suction stroke and the compression stroke. In this embodiment, when the piston 21 is located at the top dead center, the sidewall of the piston 21 is sealed with the second air suction hole 12. That is, a length of the piston 21 is at least greater than 0.5S. Thus, when the piston 21 moves to the top dead center, the sidewall of the piston 21 still blocks the second air suction hole 12.

Further, in this embodiment, the second air suction hole 12 is a circular hole. When a cross-section of the second air suction hole 12 is circular, since inner wall surfaces are subjected to a same pressure, the stress of the second air suction hole 12 is the most uniform and the strength is the highest.

In an exemplary embodiment of the present disclosure, in addition to adjusting the opening and closing duration of the second air suction hole 12, an air supply quantity of the second air suction hole 12 can also be adjusted by adjusting a diameter of the second air suction hole 12. In this embodiment, a diameter of the second air suction hole 12 is D1, where D1≤6 mm.

In an exemplary embodiment of the present disclosure, in this embodiment, the compressor 100 further includes a first air suction tube 3 and a second air suction tube 4. The first refrigeration flow path is in communication with the first air suction hole 11 through the first air suction tube 3, and the second refrigeration flow path is in communication with the second air suction hole 12 through the second air suction tube 4. Therefore, two refrigeration flow paths can be arranged in parallel by arranging two air suction tubes to communicate two corresponding air suction holes and two refrigeration flow paths, to provide two refrigerant airflows with different pressures.

It can be understood that a way to realize that refrigerant airflow with two different pressures corresponding to the first air suction hole 11 and the second air suction hole 12 respectively can enter the cylinder body 1 is not limited to adopting the above two tubes, but also only the first air suction tube 3 is provided. The first refrigeration flow path is in communication with the first air suction hole 11, and the high-pressure airflow returned from the second refrigeration flow path may directly flow into a housing 5 of the compressor 100. Then when the second air suction hole 12 is opened, the high-pressure airflow in the housing 5 is pressed into the cylinder body 1 through the second air suction hole 12. Similarly, only the second air suction tube 4 may be provided. The second refrigeration flow path is in communication with the second air suction hole 12, and the high-pressure airflow returned from the first refrigeration flow path may directly flow into the housing 5 of the compressor 100. Then when the first air suction hole 11 is opened, the high-pressure airflow in the housing 5 is pressed into the cylinder body 1 through the first air suction hole 11.

In an exemplary embodiment of the present disclosure, since various components such as the cylinder body 1, a muffler, and a crankcase are disposed in the housing 5 of the compressor 100, and an internal space of the housing 5 is relatively small. In order to realize communication of the second air suction tube 4 and reasonably utilize the internal space of the housing 5, in this embodiment, an inner diameter of the second air suction tube 4 is d1, and an outer diameter of the second air suction tube 4 is d2, where 0.3 mm≤d1≤6 mm, and 0.4 mm≤d2≤12.5 mm. In this way, the second air suction tube 4 is prevented from being too thick, interfering with other components, and being too thin, thereby affecting the air supply quantity. Moreover, a thickness of a tube wall of the second air suction tube 4 is provided correspondingly when an air pressure intensity is ensured not to damage the second air suction tube 4 and certain flexibility is achieved, thereby preventing vibration noise from being generated.

In addition, in order to achieve the above objective, the present disclosure further provides a refrigeration device, and the refrigeration device includes the compressor 100 described in the above technical solutions. It should be noted that a detailed structure of the compressor 100 of the refrigeration device may refer to the embodiments of the compressor 100, and is not described herein. Since the compressor 100 is used in the refrigeration device of the present disclosure, the embodiments of the refrigeration device of the present disclosure include all technical solutions of all embodiments of the compressor 100. The technical effects achieved are completely the same, and are not described herein.

It should be noted that a specific form of the refrigeration device is not limited, and may be a refrigerator, a dehumidifier, or other equipment. In an exemplary embodiment of the present disclosure, the refrigeration device is a refrigerator.

Further, in order to enable the compressor 100 to operate normally, the second air suction hole 12 can normally intake air in the air suction process and compression process of the cylinder body 1. In this embodiment, an intake pressure of the first air suction hole 11 is P1, and an intake pressure of the second air suction hole 12 is P2, where $1<P2/P1\leq 6$. In this way, two parallel flow paths, namely, a freezer refrigeration flow path and a refrigerator refrigeration flow path, are provided. That is, the compressor 100 can reasonably distribute the high-temperature and high-pressure refrigerant formed by compression to the freezer refrigeration flow path and the refrigerator refrigeration flow path. Therefore, when the cylinder body 1 compresses the refrigerant airflow conveyed by the first air suction hole 11, the second air suction hole 12 can supply air to the operating cavity 1*a*. In this way, the air suction quantity of the operating cavity 1*a* of the cylinder body 1 is increased, and the compression refrigeration capacity and energy efficiency of the compressor are further improved. In addition, respective operating conditions are realized through the two parallel flow paths, reducing power consumption.

The above description is only a preferred embodiment of the present disclosure, and does not limit the patent scope of the present disclosure. Any equivalent structural transformation made by using the description and attached drawings of the present disclosure under the inventive concept of the present disclosure, or directly/indirectly applied to other related technical fields, is included in the patent protection scope of the present disclosure.

What is claimed is:

1. A compressor comprising:

a cylinder body having a first air suction hole formed at a cylinder cover of the cylinder body, the first air suction hole being configured to connect to a first refrigeration flow path; and a piston assembly comprising a piston movably disposed in the cylinder body, an operating cavity being formed between the piston and a bottom of the cylinder body, the piston having a top dead center at the cylinder cover of the cylinder body and a bottom dead center away from the cylinder cover of the cylinder body in a movement stroke, and a distance between the top dead center and the bottom dead center being S, wherein the cylinder body has a second air suction hole configured to connect to a second refrigeration flow path, the second air suction hole being configured to connect to the operating cavity when the piston moves to a predetermined position, and a distance between the piston at the predetermined position and the top dead center being L1, where $L1>0.5$ S.

2. The compressor according to claim 1, wherein the second air suction hole penetrates a sidewall of the cylinder body, a distance between the second air suction hole and the top dead center being L2, where $L2>0.5$ S.

3. The compressor according to claim 2, wherein a sidewall of the piston covers and seals the second air suction hole when the piston is located at the top dead center.

4. The compressor according to claim 2, wherein the second air suction hole is a circular hole.

5. The compressor according to claim 2, wherein a diameter of the second air suction hole is D1, where $D1\leq 6$ mm.

6. The compressor according to claim 1, further comprising:

a first air suction tube, the first refrigeration flow path being in communication with the first air suction hole through the first air suction tube; and a second air suction tube, the second refrigeration flow path being in communication with the second air suction hole through the second air suction tube.

7. The compressor according to claim 6, wherein an inner diameter of the second air suction tube is d1, and an outer diameter of the second air suction tube is d2, where $0.3\ \text{mm}\leq d1\leq 6$ mm, and $0.4\ \text{mm}\leq d2\leq 12.5$ mm.

8. A refrigeration device comprising the compressor according to claim 1.

9. The refrigeration device according to claim 8, wherein the refrigeration device comprises a refrigerator.

10. The refrigeration device according to claim 9, wherein an intake pressure of the first air suction hole is P1, and an intake pressure of the second air suction hole is P2, where $1<P2/P1\leq 6$.

* * * * *